United States Patent [19]

Taft

[11] Patent Number: 4,653,237

[45] Date of Patent: Mar. 31, 1987

[54] COMPOSITE STEEL AND CONCRETE TRUSS FLOOR CONSTRUCTION

[75] Inventor: Buckie A. Taft, Bellevue, Wash.

[73] Assignee: Steel Research Incorporated, Redmond, Wash.

[21] Appl. No.: 584,731

[22] Filed: Feb. 29, 1984

[51] Int. Cl.[4] ..... E04B 1/16

[52] U.S. Cl. ..... 52/335; 52/338; 52/693; 52/334

[58] Field of Search ..... 52/326, 333, 334, 335, 52/338, 336, 337, 339, 720, 692, 690, 693, 694

[56] References Cited

U.S. PATENT DOCUMENTS

| | | | |
|---|---|---|---|
| 1,629,479 | 5/1927 | Cober | 52/326 |
| 1,725,501 | 8/1929 | Yeager | 52/335 |
| 1,968,045 | 7/1934 | Kotrbaty | 52/220 |
| 2,169,253 | 8/1939 | Kotrbaty | 52/693 |
| 3,300,932 | 1/1967 | Ratliff | 52/339 |
| 3,362,121 | 1/1968 | Weber | 52/334 |
| 3,596,421 | 8/1971 | Miller | 52/333 |
| 3,728,835 | 4/1973 | McManus | 52/336 |
| 4,056,908 | 11/1977 | McManus | 52/335 |
| 4,333,280 | 6/1982 | Marton | 52/336 |
| 4,432,178 | 2/1984 | Taft | 52/334 |
| 4,454,695 | 6/1984 | Person | 52/338 |

FOREIGN PATENT DOCUMENTS

| | | | |
|---|---|---|---|
| 1086275 | 10/1967 | United Kingdom | 52/335 |

*Primary Examiner*—Henry E. Raduazo
*Attorney, Agent, or Firm*—George M. Cole

[57] ABSTRACT

A steel and concrete secondary truss type framing member, steel deck concrete floor construction in which the top chord of the truss is formed in the shape of a modified "I" section having an upper flange, web and lower flange with a generally flat upper bearing surface of greater dimension than the upper flange for supporting steel decking. The upper flange and web of the top chord are totally embedded in the concrete to cause the concrete floor and steel truss to function together structurally as a composite system. The top chord of the truss acts as a continuous shear connector thus enabling the top chord to perform a multi-purpose function. Additionally, the top chord web may be either a solid section or contain perforations.

4 Claims, 7 Drawing Figures

FIG. 1
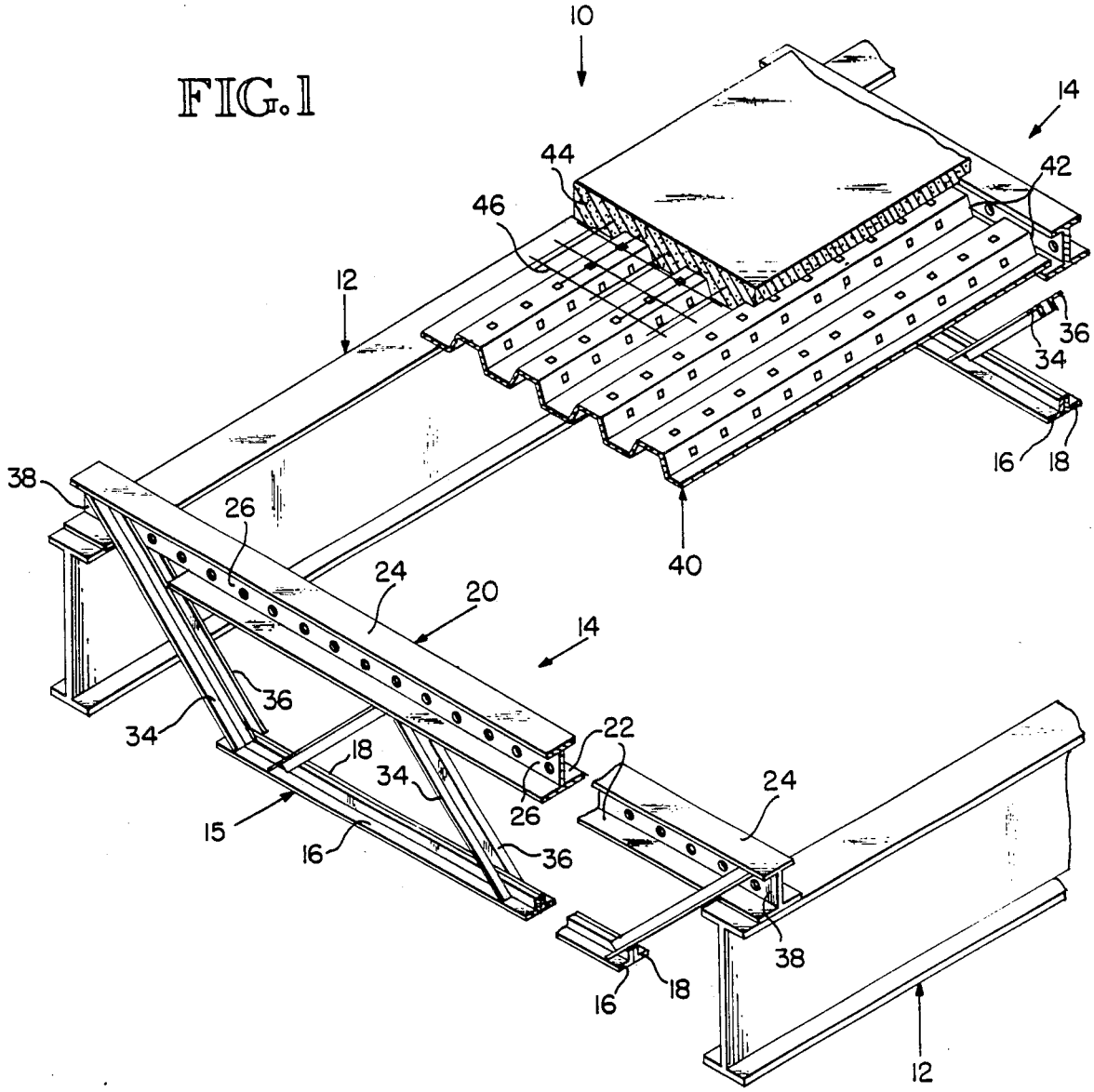
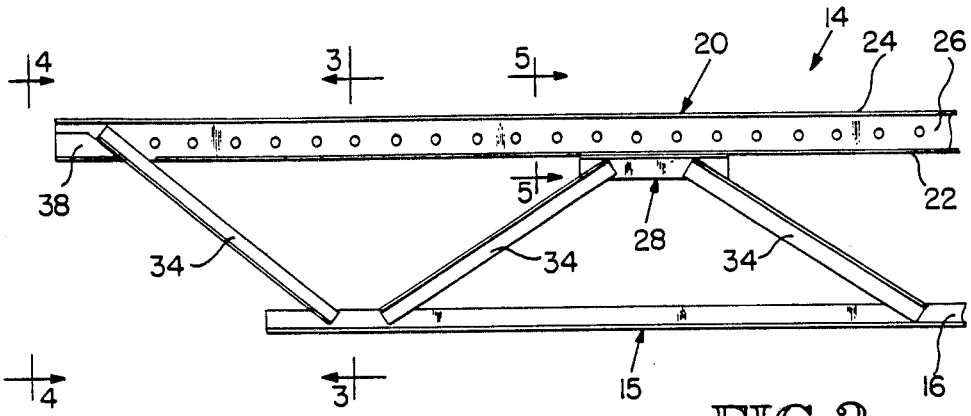
FIG. 2

FIG. 3
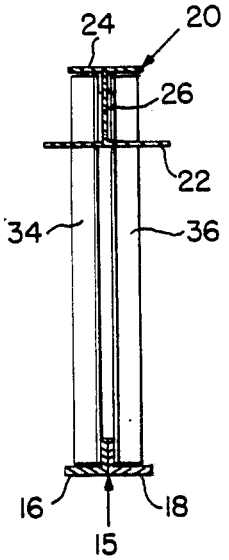
FIG. 4
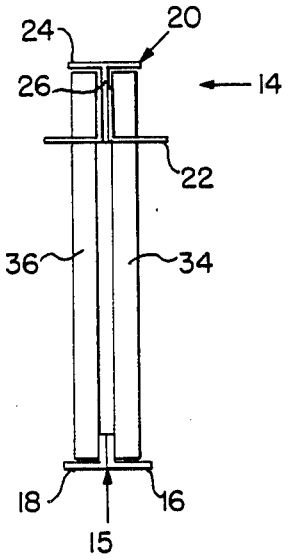
FIG. 5
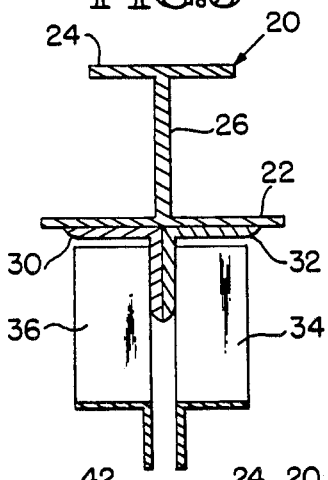
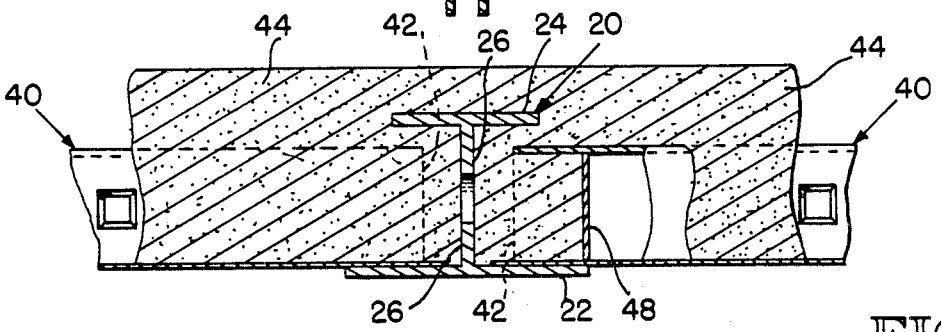
FIG. 6
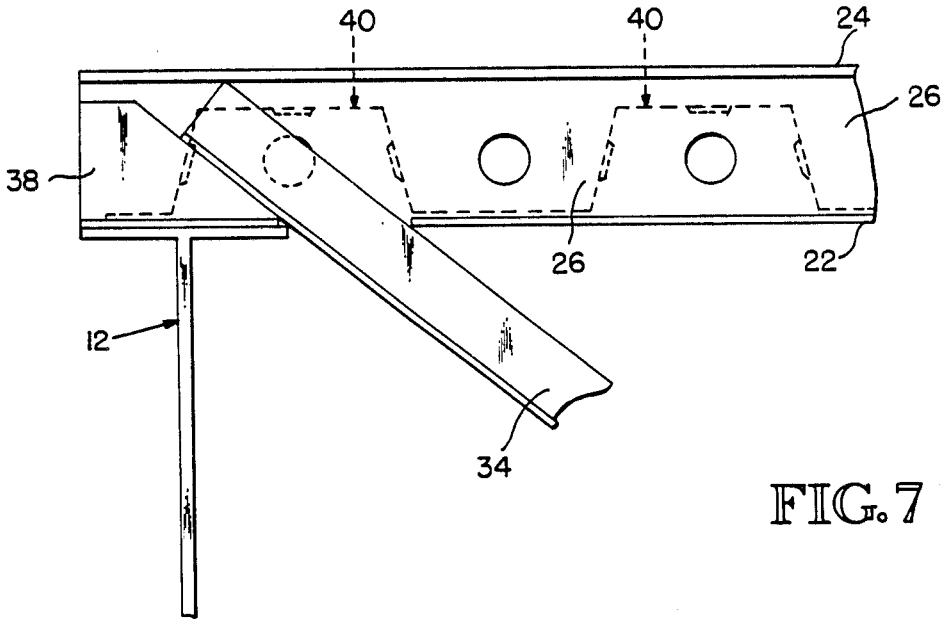
FIG. 7

COMPOSITE STEEL AND CONCRETE TRUSS FLOOR CONSTRUCTION

BACKGROUND OF THE INVENTION

The invention relates generally to the area of steel frame and concrete floor buildings and more particularly to a secondary steel framing member, in the form of a truss, in which the top chord of a specific configuration supports steel deck and acts as the shear connector in a composite system.

Composite design has been used in the construction industry for many years. The development and sophistication of economic structural systems has gradually extended to steel and concrete floor construction, the result of which has been to significantly reduce cost of steel framing in the industry. However, composite construction has generally been confined to primary wide flange or solid section members with stud-type shear connectors welded onto the top flanges in the field.

As those skilled in the industry are aware, conventional composite design consists essentially of three elements; that is, concrete, a steel beam or joist and a shear transfer mechanism. In the past, the shear transfer mechanism has usually been a stud shear-connector welded to the top flange of the beam and then the stud was encased in the concrete with the concrete slab generally above the plane of the top flange. Obviously, the shear-connecting device or stud, properly welded to the top flange of the beam, must be capable of resisting the shear force between the beam and the concrete to produce the desired composite action.

It will be appreciated that the purposes of composite floor construction are to save considerable steel weight and cost, as well as to reduce depth and deflection. While secondary framing members have been used in composite construction with steel decking, the manner of providing for shear transfer through use of the top chord of the secondary framing member has varied. Generally with respect to systems employing steel decking, the top chord of the secondary member has not been embedded in the concrete or the deck is not supported directly by the top chord, largely because of the varying specific designs or configurations of the top chords.

Among the prior art patents which are considered to be of interest with respect to the instant invention are U.S. Pat. Nos. 4,432,178; 4,295,310; 4,259,822; 4,056,908; 3,845,594; 3,728,835; 3,683,580; and 3,147,571. The patents just cited are directed to secondary member composite floor construction with steel decking but which neither individually nor in combination anticipate applicant's system.

The McManus patents for example show a combination joist and concrete composite system together with steel decking but are directed to features such as pan closures at the ends of the joists and protruding web apex portions as part of the shear transfer interconnection but without the top chord being embedded. Again, and as stated above, these references do not teach or suggest the combination of elements set forth in the claims herein. The Taft patent in FIG. 7 shows support of the decking on the bottom flange of a primary truss-type framing member. However, the instant application is directed to a secondary member with a configuration specifically designed to support steel deck.

SUMMARY OF THE INVENTION

The invention comprises the top chord of a secondary truss type framing member as a continuous shear connector in composite construction. The top chord is formed with upper and lower flanges and such that the lower flange provides on each side of the web sufficient flat planar bearing surface for sufficient structural support at the ends of the steel decking. All of the web and all of the upper flange of the top chord are embedded in the concrete. The decking is placed, usually with mesh, and in such a way as to achieve this embedment, and the concrete poured to a predetermined depth above the top surface of the upper flange. The web of the top chord may or may not be perforated.

Accordingly, it is among the many features of the invention to use the top chord of the secondary truss in a multi-purpose function. First, it supports the steel decking, second, it acts as a conventional top chord to support construction loads, third, it acts as a screed guide in the pouring process, and fourth, it is a continuous shear connector in the composite stage. Because of the composite design the secondary truss depth can be considerably less than a non-composite truss for the same structural requirements, or at the same depth, and will provide a considerable weight saving. Because floor stiffness is increased by composite action, deflection is reduced substantially since there is a higher moment of inertia due to composite action. The uniique design and configuration of the top chord of the secondary truss member in conjunction with its support of the steel decking enable substantially total embedment of the top chord in the concrete slab.

BRIEF DESCRIPTION OF DRAWINGS

FIG. 1 is a partial isometric view showing some parts broken away to illustrate details of a preferred embodiment of the invention;

FIG. 2 is a partial side elevation view showing details of the truss and its top flange;

FIG. 3 is a cross-sectional view along the line 3—3 of FIG. 2 illustrating details of the invention;

FIG. 4 is an end elevational view taken along the line 4—4 of FIG. 2 further illustrating additional details of the invention;

FIG. 5 is a partial cross-sectional view taken along the line 5—5 of FIG. 2 showing additional details of the top chord of the truss;

FIG. 6 is a partial cross-sectional view of the top chord, steel decking and concrete slab of a composite floor structure according to this invention with a portion broken away to show closure placement for the decking; and FIG. 7 is a partial cross-sectional elevation view showing additional details of steel decking supported on the bottom flange of the top chord.

DESCRIPTION OF PREFERRED EMBODIMENT

It will be seen by reference to the drawings that the framing structure, generally designated by the number 10 as in FIG. 1, is comprised of primary framing members such as girders or beams 12 and secondary framing members 14 which are supported at each end by the primary framing members 12. The secondary members have a bottom chord 15 comprised of two abutting or separated angle members 16 and 18. A top chord 20 is shaped generally as a modified "I" section except that the bottom flange 22 is wider than the top flange 24.

Also, it is important to the invention that the upper surface of the bottom flange be generally flat and provide sufficient bearing surface for the decking plates supported on the bottom flange to satisfy engineering specifications. Thus, the top surface of bottom flange 22, connected by web 26 to top flange 24, is essentially planar and of greater width than the top flange. For instance, top chord member 20 may be 4 inches across the top flange, 4 inches deep at web 26 and 6 inches across bottom flange 22.

The web 26 of the top chord 20 of the truss 14 may be solid or perforated. The truss 14 is completed by the provision of spaced connectors 28 shown in FIGS. 2 and 5 and in this case made of back-to-back welded angle irons 30 and 32. The connections 28 support the interconnecting web angle members 34 and 36 which are secured as by welding to the connections 28 and to the abutting legs of the bottom chord angles 16 and 18 and disposed at a predetermined slope. It will also be appreciated that web angle members 34 and 36 extend to each side of the connections 28 and that the legs 16 and 18 of bottom chord angles 15 and are welded at predetermined locations according to design specifications. For the end web members 34 and 36, openings will be cut in the bottom flange 22 to allow web members to extend through said opening and to be welded to the web 26 of the top chord 20. Bearing plates 38 are provided at each end of the top chord member 20 for bearing support on beam or girder 12.

Once the primary framing members 12 and the secondary framing members 14 are in place, the decking 40 and concrete 42 may be added. It will be seen in FIG. 6 that when the decking is installed it is supported by the wider lower flange of the top chord 20 with sufficient flat bearing surface to satisfy design requirements. The ends 42 of the decking are seen to be spaced a predetermined distance from the web 26 of the top chord member 20 so that concrete will embed the top chord member from the top surface of its lower flange 22. The concrete will be poured to form a slab completely embedding the upper flange 24 of top chord member 20 to a predetermined depth over the top of the upper flange 24. The decking will be designed to satisfy span and load requirements. The extra wide lower flange 22 of the top chord member 20 for deck support enables all of the web and upper flange, or substantially all of the top chord, to be embedded in the concrete slab 44. It will be noted that standard wire reinforcing mesh 46 may be added before the slab 44 is poured to control shrinkage and cracking. It will also be observed that since the ends 42 of the decking 40 are spaced a predetermined distance from top chord web 26 conventional closure members 48 are provided on the underside of the ridges to prevent fresh cement from leaking through. The closures 48 are recessed under the ridge portions of the deck in line with the outer edges of the lower flange as seen in FIG. 6. Thus, concrete will flow into the area between the web 26 and closure 48 to allow for full width embedment through the ridge portions of the deck.

What is claimed is:

1. In a composite steel truss and concrete floor construction having spaced-apart secondary steel open web truss framing members supported at their ends on primary framing members, and further including steel decking means and a concrete slab extending between said secondary members, the improvements comprising:

(a) top chord means for said secondary open web truss framing members having a top flange, bottom flange and interconnecting web, said bottom flange including a generally flat, planar steel deck supporting surface on each side of and extending from said interconnecting web and sufficiently wide to present a predetermined amount of supporting surface for support of said steel decking means, said steel decking means having end edges spaced generally horizontally outwardly away from said interconnecting web a predetermined distance, (b) bottom chord means for said secondary open web truss framing members and open frame web means structurally interconnecting said top and bottom chord means, (c) said concrete slab means being formed so as to extend from said steel decking and generally from said bottom flange upwardly to embed all of said interconnecting web means and said top flange of said top chord means in said concrete to a level above said top flange means and thereby causing said top chord means to function as a continuous shear transfer connector means in said composite floor construction, (d) said decking having alternate ridge and valley portions and wherein closure members are disposed under each of said ridge portions to prevent leakage of wet concrete from beneath said decking, and (e) said closure members being disposed under said ridge portions of said decking so that concrete beneath said ridge portions is disposed over substantially the entire width of said bottom flange.

2. In a composite steel truss and concrete floor construction having spaced-apart secondary steel open web truss framing members supported at their ends on primary framing members, and further including steel decking means and a concrete slab extending between said secondary members, the improvements comprising:

(a) top chord means for said secondary open web truss framing members having a top flange, bottom flange and interconnecting web, said bottom flange including a generally flat, planar steel deck supporting surface on each side of and extending from said interconnecting web and sufficiently wide to present a predetermined amount of supporting surface for support of said steel decking means, said steel decking means having end edges spaced generally horizontally outwardly away from said interconnecting web a predetermined distance, (b) a bottom chord means for said secondary open web truss framing members and open frame web means structurally interconnecting said top and bottom chord means, (c) said concrete slab means being formed so as to extend from said steel decking and generally from said bottom flange upwardly to embed all of said interconnecting web means and said top flange of said top chord means in said concrete to a level above said top flange means and thereby causing said top chord means to function as a continuous shear transfer connector means in said composite floor construction, and (d) said interconnecting web of said of said top chord being perforated with a series of openings therethrough.

3. The composite steel truss and concrete floor construction according to claim 2 and wherein said interconnecting web of said top chord is a substantially solid member.

4. The composite steel truss and concrete floor construction according to claim 1 and in which said bottom flange is wider than said top flange.

* * * * *